United States Patent [19]

Higuchi et al.

[11] Patent Number: 4,587,142

[45] Date of Patent: May 6, 1986

[54] ARTIFICIAL GRAIN LEATHER

[75] Inventors: Akira Higuchi; Hisao Shimizu, both of Otsu, Japan

[73] Assignee: Toray Industries, Inc., Tokyo, Japan

[21] Appl. No.: 622,855

[22] Filed: Jun. 21, 1984

[30] Foreign Application Priority Data

Jul. 12, 1983 [JP] Japan ..... 58-126449

[51] Int. Cl.[4] ..... B32B 5/02; B32B 33/00

[52] U.S. Cl. ..... 428/15; 428/91; 428/151; 428/156; 428/903; 428/904

[58] Field of Search ..... 428/15, 151, 904, 540, 428/91, 903, 156

[56] References Cited

U.S. PATENT DOCUMENTS 4,276,101 6/1981 Lyons ..... 428/151
4,298,644 11/1981 Shimuzu et al. ..... 428/91
4,318,949 3/1982 Okamoto et al. ..... 428/91
4,390,566 6/1983 Umezawa et al. ..... 428/91

FOREIGN PATENT DOCUMENTS 57-112477 7/1982 Japan ..... 428/91

*Primary Examiner*—Paul J. Thibodeau
*Attorney, Agent, or Firm*—Austin R. Miller

[57] ABSTRACT

The present invention concerns an artificial grain leather comprising a fibrous substrate and a coating layer, said substrate comprising a body portion of entangled ultrafine fibers and a surface portion of non-entangled ultrafine fibers, said coating layer being composed mainly of an elastic high polymer, and said coating layer, said portion of non-entangled ultrafine fibers and said portion of entangled ultrafine fibers being continuously connected in this order.

15 Claims, 7 Drawing Figures

ARTIFICIAL GRAIN LEATHER

BACKGROUND OF THE INVENTION

1. Field of the Invention

The present invention is related to a new artificial grain leather which enables the easy application of textured crimps, the leather having a feeling of high quality in creases, a high bond strength between the coating and the base fabric, and not a paper-like touch, but a softness with a feeling of fullness like natural leather. Furthermore, the present invention is related to a new artificial grain leather which offers excellent air permeability, moisture vapor transmission, and water repellency, in addition to the above-mentioned features.

2. Description of the Prior Art

A large number of artificial grain leathers in which the base material and the coating are bonded together have been proposed in the past. Furthermore, the market demand for fabrics with softness and flexibility has been strong in recent years. Although realization of a soft texture alone can be simply achieved with conventional technology, softness and strength are in an inversely proportional relationship, and the problem was what artificial grain leather would first satisfy these antinomic properties at a practical price. Furthermore, the attainment of a sense of high quality in creases and the easy crimping and wrinkling of fabrics are also inversely proportional to softness. No product which offers all the qualities of these properties integrated with normal physical properties at a level enabling practical use is known.

Further, there are no products which sufficiently and simultaneously offer both air permeability and moisture vapor transmission. When requirements for a high quality appearance and texture are also considered, there are even fewer products which offer satisfaction.

Methods for providing an artificial grain leather with air permeability and moisture vapor transmission include the following: formation of pores with a foaming agent; formation of pores by addition of a water soluble material and then extracting this material; surface finishing of the fabric with a porous film obtained through a wet coagulation technique.

In each of these methods, the pores are distributed randomly. When many large pores are formed to satisfy the need for both air permeability and moisture vapor transmission, these same pores become the weak point of the artificial grain leather; they weaken the grain surface strength, repeated tensile strength, and repeated shear strength, and impair the surface luster and color tones.

SUMMARY OF THE INVENTION

It is an object of the present invention to provide a new artificial grain leather which provides a feeling of fullness like natural leather in addition to being soft, having high overall strength in both the coating and artificial grain leather, and having superior crumple formability while not creasing at an acute angle like paper when folded.

It is another object of the present invention to provide a new artificial grain leather which has on the face a coating which possesses the same appearance of grain as natural leather; the back of the fabric may be napped and may exhibit the appearance of a natural suede, nubuck, velour or buckskin. Thus, a new artificial grain leather according to this invention may feature a double face.

It is a further object of the present invention to provide a new artificial grain leather which satisfies the need for both air permeability and moisture vapor transmission, and which has a superior appearance and grain surface strength.

These objects are accomplished by the present invention as described herebelow.

Specifically, the new artificial grain leather according to the present invention has a base fabric having a portion at or near the surface which is composed of a non-entangled fibers layer made primarily from superfine filaments, and having a body portion comprising an entangled fibers layer made primarily from superfine filaments, and a coating applied to the non-entangled fibers portion, which coating is made primarily from an elastic high polymer. Moreover, the new artificial grain leather according to the present invention features a construction in which the above-mentioned coating, non-entangled fibers layer, and entangled fibers layer are in a regular, consecutive succession in that order.

BRIEF DESCRIPTION OF THE DRAWINGS

FIG. 3 shows the surface of artificial grain leather according to the present invention with many pores;

FIG. 5 shows the surface of artificial grain leather according to the present invention with few pores;

FIG. 4 shows the surface of artificial grain leather according to the present invention intermediate between the leathers of FIG. 3 and FIG. 5. The pores as shown in FIGS. 3 through 5 are concentrated in a partial area.

FIG. 6 and 7 are of leathers in which the pores are randomly distributed; FIG. 6 is an artificial grain leather according to the present invention with few pores; FIG. 7 is an artificial grain leather according to the present invention with many pores.

DESCRIPTION OF THE PREFERRED EMBODIMENTS

Figure 1:
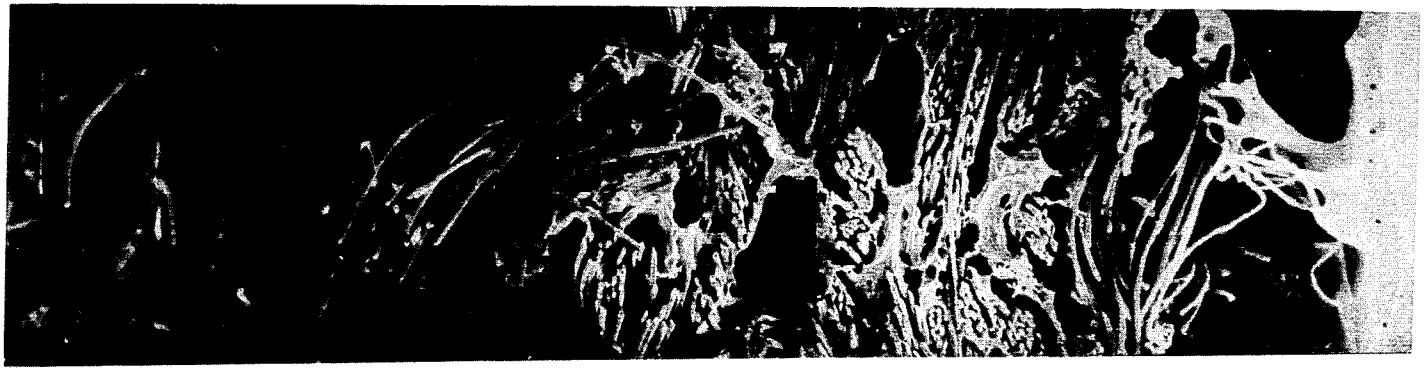
FIG. 1 shows the cross-sectional construction of a new artificial grain leather according to the present invention.

The new artificial grain leather of the present invention can be obtained through a process such as described below; however, production of this new artificial grain leather is not limited to this process alone.

For example, a non-woven fabric composed of islands-in-a-sea type fibers is shrunk and dried. The non-woven fabric has usually been formed by an entangling process such as needle-punching or the like, and the fibers are entangled. This fabric is impregnated with a mixed solution of a sizing agent dissolved in an aqueous polyurethane emulsion, the sea component is extracted after drying the fabric, and the fabric is then dried. The fabric is again impregnated with an aqueous solution containing a dissolved sizing agent, filling the gaps left by extracting the sea component, and the fabric is dried. Extraction of the sea component has, of course, liberated the ultrafine fibers which comprise the islands, which ultrafine fibers remain entangled because of the original entanglement of the islands-in-a-sea type fibers originally used. The fabric is next impregnated with a wet coagulating polyurethane dimethyl formamide (DMF) solution; wet coagulation is induced in the aforementioned non-solvent polyurethane solution, the fabric is desized and treated to remove the solvent. The fabric is then sliced to obtain two sheets. Both sides of this sheet are then buffed, and the sheet is processed so that the raised fiber (nap) on the side which was sliced is short and the nap on the opposite side is long. This process yields a raw fibrous substrate ready to be dyed.

The naps on the fabric surfaces are composed of essentially "non-entangled" ultrafine fibers as defined herein. Although some intermingling may take place among the fibers of the nap at various stages of the process and in the product, the nap fibers are not structurally entangled with each other in the sense of the structural entanglement of the body portion, and the expression "non-entangled" is intended to be so understood.

The base fabric is obtained by using a fluid dyeing machine to dye the fabric. The fabrics are well-known and highly commercially successful, and have been produced and sold under various U.S. Patents to Okamoto et al, including, U.S. Pat. Nos. 3705226, 3932687.

Uniting the coating layer with the substrate sheet is carried out as follows.

First, a linear type polyurethane solution is applied to a releasable support (one with a grain pattern), and the solution is dried. Then a 25% solution of reactive type polyurethane is applied over this coating on the releasable support. Solvent is removed. Then the napped surface of non-entangled fibers of the fibrous substrate is bonded to this polyurethane layer. The coating layer and fibrous substrate are dried and aged.

The aforementioned releasable base is next removed, leaving polyurethane adhered to the napped surface. If necessary, the surface of the fabric is embossed, treated for color or luster, and crumpled.

The process is carried out in a manner to produce specially arranged pores in the coating layer. In the process described above, the amount of coating applied, dryness of the coating, and coating-to-fabric bonding conditions can be adjusted to regulate the degree of penetration of the coating into the base fabric, and thereby obtain an artificial grain leather with pores of optimum size, distribution, and distribution area.

The fibers which can be used for the fibrous substrate of the present invention include multicomponent fibers such as special polymer-blended type fibers, stripped-off type fibers, high molecular inter-arrangement fibers, islands-in-a-sea type composite fibers, and other ultrafine fiber formable fibers. Typical fibers are disclosed in U.S. Pat. Nos. 4,350,006, 4,051,287, 4,241,122. Other type fibers such as fibers made by super-draw spinning, strong blowing spinning with air, etc. may also be used. Normal fibers may be blended with any of the above-mentioned fibers insofar as they do not impair the objectives and results of the invention. The fineness of ultrafine fibers used in the present invention is less than 0.7 denier and preferably between 0.3 to 0.0001 denier. The reasons for this include softness of texture, bonding strength of the coating and non-entangled fibers layer, the application of creases and wrinkles, and the formation of a smooth surface with a thin coating.

The fibrous substrate which can be used in the invention includes non-woven fabrics, knitted fabrics and woven fabrics, and artificial grain leather sheets of these. The fibers of all such substrates are entangled for mechanical strength. It is particularly with non-woven fabrics that new compounds according to the invention exhibit the fullness of a natural leather-like appearance; moreover, with non-woven fabrics special consideration need not be given to the appearance of the texture of the fabric as with woven or knitted fabrics.

Furthermore, the base fabric in the invention includes those fabrics impregnated with polyurethane, polyvinyl chloride, polyacrylic ester, polyvinyl acetate, natural rubber, synthetic rubber, as well as related compounds, copolymers and compounds of these.

One of the more important features of the present invention is the surface of the fibrous substrate on which the coating layer is formed. The nap density is preferably 50,000 to 250,000 fibers/cm$^2$; more preferably 80,000 to 160,000 fibers/cm$^2$; and the nap fiber length is preferably 0.01 to 3.0 mm, more preferably 0.1 to 2.0 mm.

The elastic high polymers used for the coating in the present invention include polyurethane urea, polyurethane, polyamide, polyvinyl chloride, polyester, polyvinyl acetate, polyacrylonitrile, polyamino acid, natural and synthetic rubbers, silicone resins, as well as copolymers and compounds of these; in addition, dyes, pigments, lubricants, levelers, plasticizers, antioxidants, ultraviolet absorbers, and other agents may be mixed as may be necessary and insofar as they do not impair the objectives of the invention. Furthermore, it is preferable to use for the coating resin a product which has sufficient bond strength, coating strength, and washability, is virtually non-soluble in dimethyl formamide and which has the capability of forming a network polymer.

Furthermore, it is preferable to use for the aforementioned elastic high polymer a product which is transparent; in addition, it is preferable for the product to be of a transparent color which is used to produce characteristic color effects by subtly combining with the colored of the base material.

In order to form a non-entangled fibers layer to be interposed between the coating and the entangled fibers layer, a solution or dispersion of the elastic high polymer used to form the coating is applied to the exposed surface of the fabric by the use of a support which carries the coating. The releasable support and coating are only applied to the surface of the fabric after being heated and/or blown with air until the solid density of the coating is preferably 1.3 to 4.5 times the solid density of the undiluted polyurethane solution, more preferably 1.5 to 4.0 times as stated, the releasable support carrying the concentrated polyurethane solution is layered with the fabric sheet; the two layered sheets are then passed together between rollers with a clearance of 7 to 70% of the thickness of the combined sheets, 15 to 45% in a preferred process, and dried thoroughly. If necessary the sheets are cured while combined and in any event the releasable base is removed to produce the fabric sheet with the coating thereon. In addition, it is possible after the removal of the releasable support to apply coloring or polishing, embossing, or crumpling to the surface of the coating on the fabric. In particular, the crumpling process will soften the artificial grain leather, and special molding methods for the non-entangled fibers layer and the above coating exhibit the feature of adding a unique textured crimp.

The artificial grain leather according to the present invention features a low density layer composed of non-entangled ultrafine fibers that is contracted with the coating, and this is the reason why the coating layer can flex in all directions (in the direction of the face and thickness) when the coating layer has stress applied to it.

The structure is designed so that stress is not absorbed by the coating layer but escapes across the exterior of the coating layer. To achieve this the density of the non-entangled fibers layer is preferably 0.01 to 0.19 g/cm$^3$, more preferably 0.03 to 0.13 g/cm$^3$. Furthermore, the thickness should be preferably 0.01 to 0.35 mm, more preferably 0.05 to 0.2 mm in the preferred embodiment. The density of the entangled fibers layer should be preferably 0.18 to 0.50 g/cm$^3$, more preferably 0.25 to 0.4 g/cm$^3$.The density of the coating layer is preferably 0.9 to 1.3 g/cm$^3$, more preferably 1.0 to 1.2 g/m$^3$. And the thickness of the coating layer should be preferably less than 100 microns, more preferably from several to approximately 30 microns.

In particular, the density of the coating layer should be most preferably 0.9 to 1.3/g/cm$^3$ and 7 to 30 times the density of the non-entangled fibers layer. At densities less than seven times the density of the non-entangled fibers layer the softness of the artificial grain leather decreases, and moreover the coating layer becomes stiffer, resulting in a drop in strength of the coating layer. It also becomes more difficult to apply the textured crimps.

On the other hand, when the density of the coating is more than 30 times as great as the density of the non-entangled fibers layer, the feeling of the coating layer and fibrous substrate being a single sheet fades, and the non-entangled fibers layer cracks more easily when an external force is applied. Furthermore, when textured crimps or creases are applied, the crimps or creases become larger and it is more difficult to obtain an impression of richness.

Figure 2:
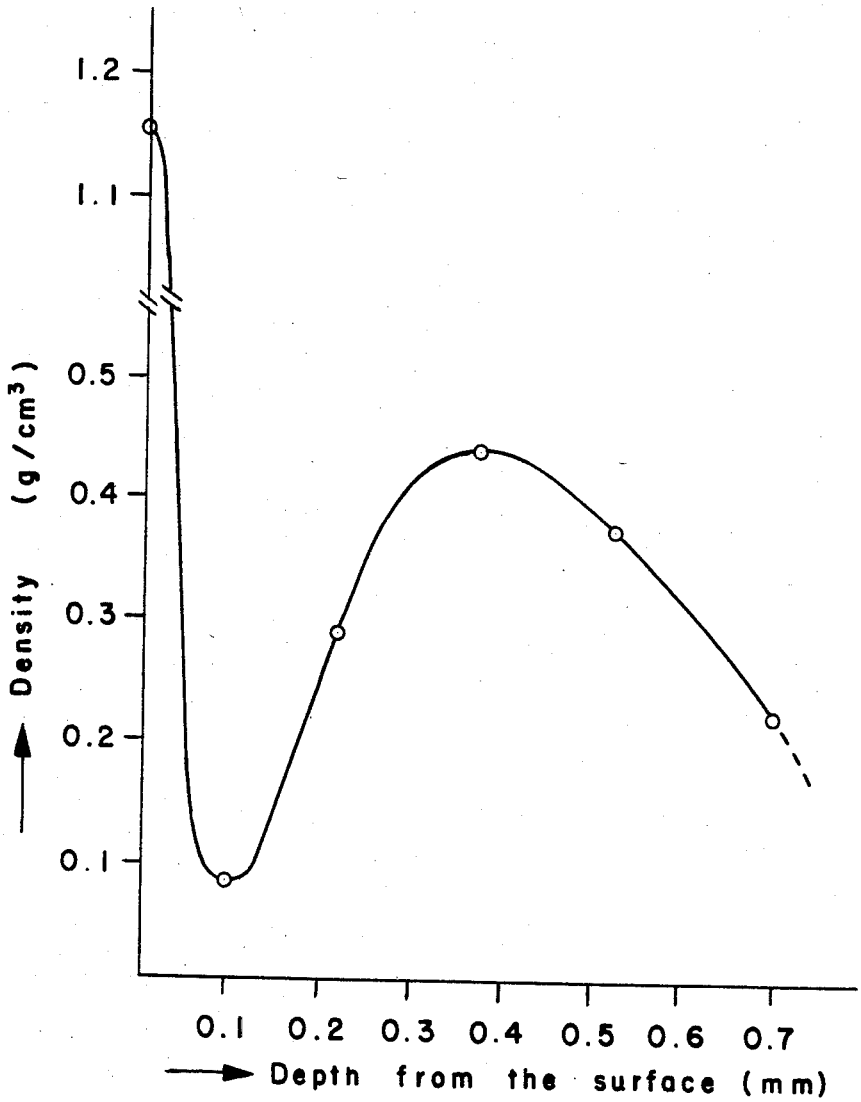
FIG. 2 shows the density in a cross-section in the direction of thickness of a new artificial grain leather according to the present invention.

FIG. 1 shows the cross-sectional structure of a new artificial grain leather according to the present invention; FIG. 2 shows a sample measurement of the density distribution in the direction of the thickness.

Density was measured as described here. First, the fabric was sliced diagonally across the length of the artificial grain leather; next it was sliced perpendicularly (in the cross-sectional direction) with the length of the artificial grain leather; samples were made and the density in each section was obtained.

Another feature of the invention is the existence of pores which contribute air permeability and moisture vapor transmission in the coating of a new artificial grain leather as above.

Large numbers of very large pores are necessary in normal artificial grain leathers provided with a coating layer, and these pores sometimes become the weak point of the fabric, adversely affecting strength. According to the present invention it is advantageous though not essential to have the pores concentrated locally or in the unelevated areas (bottom of creases or crimps). This produces an artificial grain leather product having superior strength and a higher quality exterior appearance, in comparison with a fabric which has pores distributed randomly. In some cases, however, the invention may be practiced to advantage even if the pores are randomly distributed.

In the structure of the artificial grain leather according to the invention superior strength and exterior appearance will be obtained even with a large pore area; however, these properties will naturally worsen if the pore area is too great. On the other hand, air permeability and moisture vapor transmission will be less than desirable if the pore area is excessively small. Accordingly, it is preferable that there should be sufficient pores to assure that moisture vapor transmissivity is 1000 g/m$^2$/24 hours, preferably 3000 g/m$^2$/24 hours. Furthermore, although greater air permeability is preferable, it should preferably for practical purposes be greater than 0.05 cc/cm$^2$/sec, more preferably greater than 0.1 cc/cm$^2$/sec. Accordingly, it is preferable that there be present sufficient pores of sufficient size to assure these values.

The essential parts of one method whereby a new artificial grain leather exhibiting pores in the coating as according to the present invention can be obtained are described below.

(a) When the pores are randomly distributed minute pores can be applied by regulating the penetration of the coating into the base material by adjusting the amount of coating applied, the dryness (amount of solvent remaining), and coating to base material bonding conditions. The size of the pores should be preferably less than 50 microns, more preferably less than 10 microns, in consideration of the various characteristics. In addition to thus forming the pores, a high nap density on the face of the base material is preferable.

(b) When the pores are locally concentrated, especially at unelevated areas, the mechanical properties such as grain strength, repeated tensile strength and surface luster and color tones are improved. In accomplishing this an elastic high polymer solution exhibiting appropriate fluidics is thinly applied to a releasable support having a surface that is provided with concave and convex portions, and part of the solvent for the solution is removed; the support is pressed to the fiber base material, and the product peeled off the support after drying. The product is next pressed onto an unevenly surfaced base, and released after drying.

In this method that part of the elastic high polymer coating residing at the elevated portion of the support penetrates more deeply into the fiber base when pressure is applied by an uneven surface releasable support, and the formed pores are concentrated in this area. By adjusting the size of the convex and concave sections of the support, the pattern, and bonding conditions, sheets with the desired pore size, distribution and area can be obtained. Further, the thickness of the coating applied to the smooth base is determined by the size of the impressions and bonding conditions used later with the unevenly surfaced base; in effect, the high polymer coating should be the thickness of the pores formed by bonding of the fabric and coating with the uneven surface support. The coating thickness will also depend upon the surface condition of the fiber base.

In the above process an unevenly surfaced base can also be used in place of the smooth base used at the start of the process. In this event, the pores will be substantially concentrated where the coating is thin in the unelevated portions of the initial embossed pattern when the product is pressed with the second unevenly surfaced base.

Figure 3:
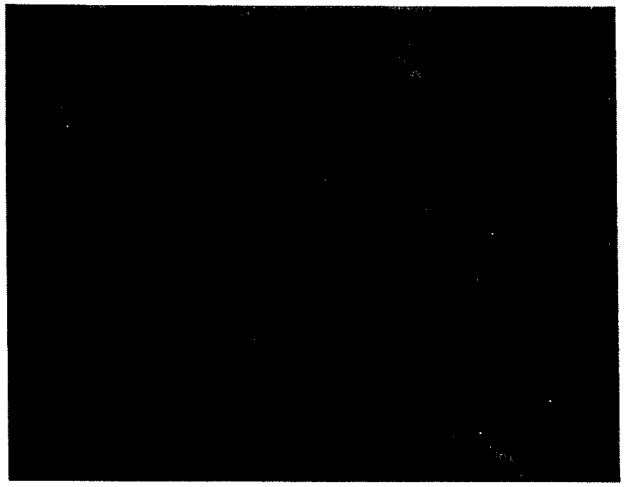
FIG. 3 through FIG. 7 are enlarged photographs showing the surface condition of a new artificial grain leather according to the present invention; these photographs show surfaces which have pores.
Figure 4:
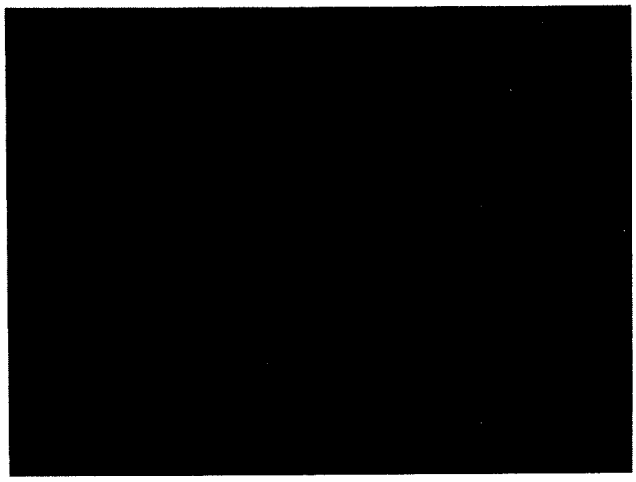
Figure 5:
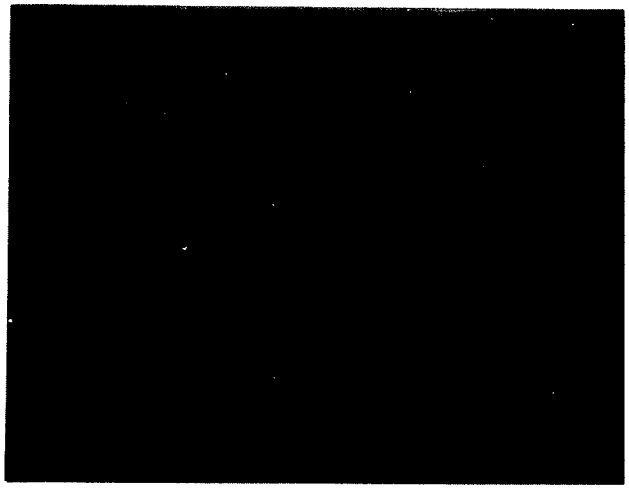
Figure 6:
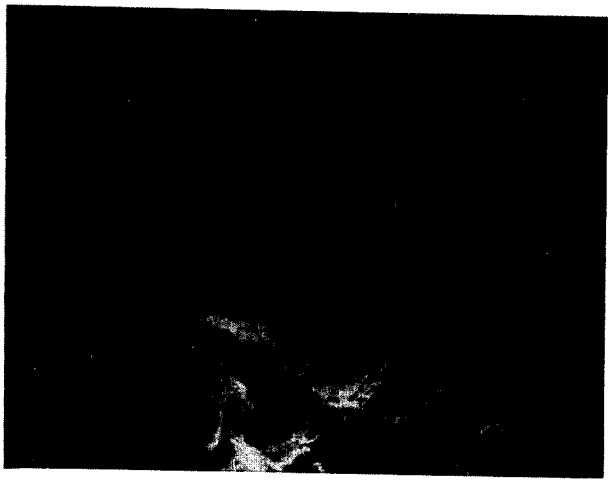
Figure 7:
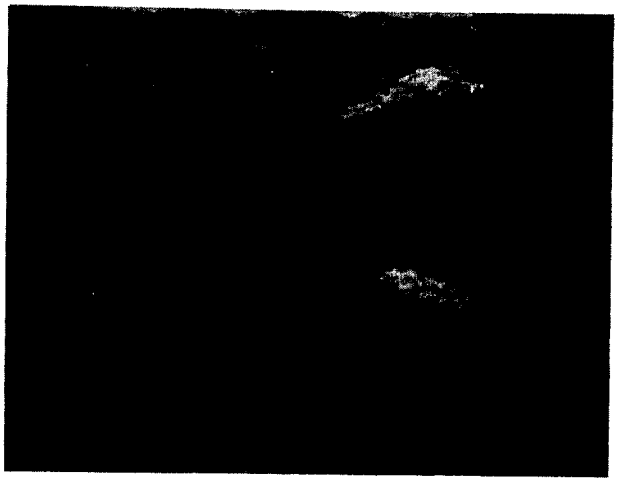

FIG. 3 through FIG. 5 show the surface of a fabric sheet obtained with varying coating thicknesses and an unevenly surfaced support. The pore area varies according to the coating thickness. In short, the number of pores increases when the coating is thin (FIG. 3), and conversely the pore area decreases when the coating is thicker (FIG. 5). In both cases, the pores are not randomly distributed but are locally concentrated. FIG. 6 and FIG. 7 show examples of randomly distributed pores.

Another process whereby a new artificial grain leather having pores can be obtained comprises mechanical opening of pores in a leather-like sheet with no pores.

(c) When the pores are concentrated in unelevated areas a high polymer solution exhibiting appropriate fluidics is applied to the unelevated portions of the laminating base whose surface is composed of elevated and unelevated patterns, and the base is pressed to the fabric. A portion of the polymer in the aforementioned unelevated areas penetrates into the surface of the base material, and a portion of the coating remains on the surface of the base. (The unelevated, or concave, areas of the base surface will become the raised, or elevated, portion of the artificial grain leather).

The coating is either not present on the elevated areas of the support surface, or if it is present it is there in such minute amounts as to not penetrate into the fabric base. (The raised portion of the support surface pattern becomes the unelevated portion of the artificial grain leather.) The support and coating are then dried, hardened, and removed.

Specific desired performance and appearance can be modified by changing the configuration of the elevated and unelevated portions of the releasable support, the amount of coating applied, fluidics, and bonding conditions.

In artificial grain leathers manufactured according to the above process, most of the pores will exist in the unelevated areas (depressions) of the fabric. After this process, the resultant sheets can be embossed or otherwise treated for a particular external appearance; however, in this case the pattern produced in the above process will be changed by the embossment, and the pores will not necessarily be randomly distributed in the unelevated sections of the pattern.

The areal ratio (a) of pores to total area in the present invention is obtained according to and should be preferably within the range of the following equation:

$$a = \frac{Hm/Sm}{Hv/Sv} = ,$$

in which

Sm = total elevated area on the grain side;

Sv = total unelevated area;

Hm = total pore area on the elevated side; and

Hv = total pore area on the unelevated side.

The smaller the value 'a' is, the more pronounced will be the effects of the invention; 'a' should be less than $\frac{1}{4}$, and less than $\frac{1}{8}$ in the preferred embodiment.

Furthermore, the area of the elevated area, unelevated area, and pore area can also be obtained from microphotographs using generally recognized methods, such as a planimeter or other area measurement device.

Superior strength and flexibility can be obtained in new products according to the present invention due to the interposition of a non-entangled fibers layer composed of superfine fibers between the polymer coating and the superfine fiber entangled fibers layer. Furthermore, when external or internal stress is applied to the polymer coating, the low density non-entangled fibers layer distributes the stress, thus having the effect of increasing the strength of the polymer coating. In addition, it becomes easier to apply crumple to the leather, and high quality creases can be obtained.

Also, if a non-entangled fibers layer (nap) is provided on the side opposite to the polymer coating, a double-face synthetic leather with grain on one side and a suede on the other can be obtained.

Moreover, a new artificial grain leather with such superior characteristics as strength and appearance of quality in the polymer coating, as well as excellent air permeability and moisture vapor transmission can be obtained by providing pores in the polymer coating.

Especially when the pores are not randomly distributed but are concentrated locally, there is a difference in the luster of areas with pores and those without pores; further, because there are also different color shades, an overall balance of luster and color tones can be obtained.

Furthermore, when the fabric is crumpled, there is a small but significant difference in the ability to apply crumple to those areas with pores and those areas without pores, enabling a feeling of naturalness in the textured areas.

In addition, when the grain side and base fabric are colored after processing of the grain side, it becomes easier to dye deeper shades in areas with pores, enabling distinctive effects with varying color shades as desired.

Also, this surface structure does not decrease the water repellency and surface strength of the fabric; rather it produces a desirable fabric in which non-porous areas display strong resistance to external forces.

Furthermore, the formation of pores primarily in the unelevated portions of the surface prevents a decrease in fabric scratch strength resulting from a large number of pores in elevated areas, and effectively represses fabric soiling. On the one hand, when the pores are concentrated in the unelevated pattern areas, light reflectance in these areas can be repressed; this eliminates the problem of shiny luster and luster in the unelevated pattern areas in conventional fabrics, thus exhibiting a natural luster, rich colors, and deep shades, while improving the water repellency, hand characteristics such as flexibility and suppleness, and drape of the leather. In order to obtain these effects, the ratio of pore area in elevated areas to pore area in unelevated areas should be preferably less than $\frac{1}{2}$. At ratios greater than $\frac{1}{2}$, overall fabric characteristics decrease and such weaknesses as low surface strength in relation to air permeability and moisture vapor transmission, easy fabric soiling, and others are emphasized.

Some actual embodiments according to the present invention are described below; however, new leather products according to the present invention are not limited to these. Unless otherwise stated, all percentages (%) and parts are in reference to weight.

EXAMPLE 1

A non-woven fabric weighing 550 g/m$^2$ is obtained with the needle punching method using ultrafine fiber formable fibers of 51 mm cut length, 3.5 denier fineness, which is composed of 65 parts of polyethylene terephthalate as the island component (the number of islands is 16) and 35 parts of polystyrene as the sea component.

This non-woven fabric is then shrunk with warm water and dried. The fabric is impregnated with an aqueous solution of sizing containing solvent resistant polyurethane and dried, thus the total weight of polyurethane and sizing applied is 25% based on the weight of the island component. The fabric is then treated in trichloroethylene to remove nearly 100% of the sea component. This is subsequently impregnated with an aqueous solution of the sizing and dried, thus the weight of the sizing is 18% based on the weight of the island component.

Following this the fabric is impregnated with a dimethyl formamide solution containing polyurethane, and coagulated in DMF-water, desized and treated for removal of the solvent, and then dried. The amount of polyurethane applied was 37% of the island component. This fabric is then sliced in half, buffed 0.1 mm on the sliced side and 0.18 mm on the opposite side to produce raw fabric substrate.

These gray goods are dyed with dispersion dye at a dyeing temperature of 125° C. using a fluid dyeing machine; the fabric is then cleaned by reduction cleaning to obtain a base material with desirable color fastness, thickness of 0.69 mm, and weighing 220 g/m$^2$. This base material has a nap density of approximately 100,000 fibers/cm$^2$, nap length on the sliced face of approximately 0.5 mm, and nap length on the back of 1.5 mm.

Carbon black is blended with a DMF solution of linear type polyurethane and the mixture is diluted to form a 10% solution. This solution is next applied to a releasable support which has grain patterns of a kid leather effect and dried to obtain a film (I) weighing 5 g/m$^2$.

Trifunctional polyisocyanate, carbon black, and silicone are blended in a solution of methyl ethyl ketone/-toluene of reactive polyurethane. This blend is diluted with toluene and dimethyl formamide to form a 25% solution. This is then applied to the top of film (I) formed on the releasable support with the grain pattern, and the said support is placed in an air dryer for 15 seconds with air speed of 10 m/sec at 50° C. (the condition required to obtain a concentration of the reactive polyurethane solution of 2.1 times the concentration of the same solution before application); the base material is immediately layed over the exposed surface of the releasable support with the sliced face of the base material having approximately 0.5 mm long raised fibers in contact with concentrated reactive polyurethane coating solution. The combined sheets are then calendared through rollers whose clearance has been adjusted to approximately 30% of the thickness of the combined sheets, and thoroughly dried at 90° C. After this the combined sheet is cured in an oven for 24 hours at 50° C., and the napped non-woven sheet is peeled from the releasable support. The coating thus applied to create an artificial grain leather has a thickness of 20 microns, density of 1.18 g/cm$^2$; the non-entangled fibers layer resulting from the nap is 0.10 mm thick, has a density of 0.08 g/cm$^2$; the entangled fibers layer is 0.59 mm thick, and has a density of 0.36 g/cm$^2$.

The resultant artificial grain leather is soft and has the feeling of fullness and hand characteristics like natural leather; it has consistent strength in both the warp and the weft; there is a sense of high quality in creases; textured crimps are easily applied, and these crimps are non-directional, with a rich, natural feeling.

For comparison test samples were made. The unbuffed grey fabric was colored as in this Example 1; coating conditions were the same as those in Example 1 except that the above base material was applied immediately after coating film (I) composed of a DMF solution of a linear type polyurethane. The difference in characteristics of this sample and the desirable artificial grain leather of the present invention are as shown in Table 1 which appears at the end of this specification. A new artificial grain leather exhibiting the above characteristics as according to the present invention was made into a double faced vest in which the face was leather-like and the back had a suede finish; a skirt was also made in which the material had alternating face leather and suede effects by slitting the new artificial grain leather 2.5 cm, alternately joining the face and back by sewing to make a sheet and then slicing this sheet in half. Because a single sheet of this fabric is double faced and exhibits the same properties on both faces, the material is easy to sew and exhibits durability with outstanding wearability.

EXAMPLE 2

A coating was formed as described below on the base material produced in Example 1.

A 5% solution of linear type polyurethane is applied to a clearance thickness of 0.02 mm on a releasable support having an uneven surface; after this dries a 15% solution of reactive polyurethane is applied to a thickness of 0.02 mm. After part of the solvent is removed, the above-mentioned fabric base is applied to the surface of the releasable support, bonded with a clearance of 0.1 mm, dried, cooled, and the releasable support peeled. This artificial grain leather is then pressed with metal rollers heated to 100° C. and having an embossed pattern on the surface. The resultant product is structured as shown in FIG. 3 of the drawings, and has an external appearance, color luster, color tone, and texture similar to those of natural leather. This is an outstanding product whose air permeability is 0.9 cc/cm$^2$/sec (JIS L 1079), moisture vapor transmission is 4800 g/cm$^2$/24 hours (JIS Z 0208), water repellency is 95 (JIS L 1079). The natural leather (sheep) measured for comparative values had air permeability of 0.3 cc/cm$^2$/sec, moisture vapor transmission of 4500 g/m$^2$/24 hours, and water repellency of 60.

Surface strength was examined with a Scott type shear fatigue tester in which the new artificial grain leather of the invention was folded 10,000 times at a 15% extension, and the external appearance of the new artificial grain leather was examined for any cracks; none were found. The same test was performed on a natural leather (sheepskin); the appearance of nominal cracks was noticeable.

The new artificial grain leather was then crumpled by a tumble dryer, resulting in a textured crimp in which the processed crimps combined with the surface crimps for an extremely natural, warm appearance and feeling. This process produced a simulated leather sheet extremely close in appearance to natural leather. The air permeability of this new artificial grain leather was 0.95 cc/cm$^2$/sec; moisture vapor transmission was 5050 cc/m$^2$/24 hrs; water repellence was 95.

The grain surface strength was measured by the same process as described above; no abnormality was observed.

EXAMPLES 3 and 4

These examples were based on Example 2 above, with the exception that the thickness of the coating was changed, and various samples with differing pore areas were used. The qualitative characteristics of this artificial grain leather are shown in Table 2 at the end of this specification.

EXAMPLE 5

An undyed material produced as in Example 1 was used for the base fabric, which was high temperature, high pressure dyed using a jet dyeing machine after application of the coating. Subsequent procedures and conditions were as described in Example 2 to produce an artificial grain leather. Irregular crimps were produced in this sheet by rub finishing, resulting in an appearance like a natural leather.

EXAMPLE 6

The base material of Example 1 was used and the coating applied as described below.

A 5% solution of primary polyurethane was applied with a reverse roll coater with a practical clearance of 0 to the surface of a releasable support with a patterned surface; after the coating dried, a 20% solution of a secondary polyurethane was applied at a clearance of 0.01 mm; after removing part of the solvent, the coating was layered onto the above fabric base material, bonded with a clearance of 0.1 mm, cooled, and the laminated base peeled off. The resultant product had an exterior appearance, surface luster, and texture similar to those of natural leather.

The air permeability of this product was 1.1 cc/cm$^2$ sec. (JIS L 1079), moisture vapor transmission of 5700 g/m$^2$/24 hrs (JIS Z 0208), water repellence of 90. The natural sheepskin measured for comparative values exhibited air permeability of 0.3 cc/cm$^2$/sec, moisture vapor transmission of 4500 g/m$^2$/24 hours, and water repellency of 60.

Damage resistance of the surface was tested with a colorfastness tester; generation of nap was looked for after the surface was rubbed 100 times with a cotton cloth at a 100 g load; no nap was observed. On the other hand, a large amount of nap was observed on the natural leather tested for comparison. This new artificial grain leather sample was then crumpled by tumble dryer to apply textured crumple; furthermore, the fibrous substrate was shrunk to emphasize the previously mentioned elevated and unelevated areas, resulting in a fabric with a rich, natural, warm texture.

EXAMPLES 7 THROUGH 9, COMPARATIVE EXAMPLES 1 AND 2

A variety of patterns were embossed with embossing rollers onto the base material used in Example 1 to change the distribution of elevated and unelevated areas, resulting in samples with varying 'a' values.

The qualitative characteristics of these samples are shown in Table 3, the flexural strength, sheer fatigue and strength being graded on a scale of 1 to 5, with 5 being best. Although all samples exhibited superior air permeability and moisture vapor transmission, nap was observed in the damage resistance test in those samples in which exceeded ½, these samples were determined to pose certain problems for actual use.

TABLE 1

| Evaluated item | Example 1 | | Comparative sample | |
|---|---|---|---|---|
| | Longitude | Latitude | Longitude | Latitude |
| Flexing strength (grade) (20° C., 300,000 times) | 5 | 5 | 4 | 2 |
| Scott shear fatigue tester (grade) 20% extension), 200,00 | 5 | 5 | 4 | 1 |

TABLE 1-continued

| Evaluated item | Example 1 | | Comparative sample | |
|---|---|---|---|---|
| | Longitude | Latitude | Longitude | Latitude |
| times) | | | | |
| Abrasion strength (grade) | 5 | 5 | 3 | 2 |
| Grain strength | 2 | 2 | 0.8 | 0.6 |
| Cantilever bending resistance (mm) | 40 | 40 | 55 | 48 |
| Crumple | Small, non-directional crumple | | Small crumple | Large paper |
| Grain pattern formation | Good | | Longitudinally n | |

TABLE 2

| | Characteristics | | |
|---|---|---|---|
| | Air permeability (cc/cm$^2$, sec) | Moisture vapor transmission (g/m$^2$, 24 hrs) | Grain Strength |
| Example 1 FIG. 1 | 0.90 | 4,800 | No cracks |
| Example 1 . FIG. 2 | 0.50 | 4,150 | No cracks |
| Example 1 FIG. 3 | 0.20 | 3,200 | No cracks |

TABLE 3

| Sample | Characteristics | | | |
|---|---|---|---|---|
| | "a" value | Air permeability | Moisture vapor transmission | Damage resistance |
| Example 6 | — | 1.1 | 5700 | No nap |
| Example 7 | 0.10 | 1.1 | 5500 | No nap |
| Example 8 | 0.25 | 1.0 | 5500 | No nap |
| Example 9 | 0.43 | 1.2 | 5800 | Slight nap |
| Comparison 1 | 0.67 | 1.1 | 5500 | Extensive nap |
| Comparison 2 | 0.92 | 1.0 | 5300 | Extensive nap |

We claim:

1. A artificial grain leather comprising a fibrous substrate and a coating layer, said fibrous substrate comprising a sheet having a body portion of entangled ultrafine fibers having a surface portion comprising a plurality of non-entangled ultrafine fibers attached to said body portion, said coating layer being formed upon said non-entangled ultrafine fibers and comprising at least a major portion of an elastic high polymer, and said coating layer, said non-entangled ultrafine fibers and said entangled ultrafine fibers being continuously connected in this order, wherein the finess of the ultrafine fibers is less than 0.7 denier, the density of non-entangled fibers is 50,000 to 250,000 fibers/cm$^2$, the length of the non-entangled fibers is 0.01–3.0 mm, and the density of the coating layer is between 0.9 and 1.3 g/cm$^3$.

2. An artificial grain leather as defined in claim 1, wherein the density of coating layer is between 7 and 30 times as great as the density of the portion of the non-entangled ultrafine fibers.

3. An artificial grain leather defined in claim 1 or claim 2, wherein said coating layer has plurality of pores.

4. An artificial grain leather defined in claim 3, wherein said coating layer has plurality of pore groups having plurality of pores concentrated.

5. An artificial grain leather as defined in claim 3, wherein said artificial grain leather has an air permeability of greater than 0.05 cc/cm$^2$/sec and moisture vapor transmission of greater than 1000 g/m$^2$/24 hours.

6. An artificial grain leather defined in claim 1, wherein said fibrous substrate is a non-woven fabric.

7. An artificial grain leather defined in claim 1, wherein said ultrafine fibers have a fineness of 0.3 to 0.0001 denier.

8. A artificial grain leather defined in claim 1, wherein said non-entangled fibers layer is a napped fibers layer.

9. An artificial grain leather defined in claim 1, wherein the density of the non-entangled fibers layer is between 0.01 to 0.19 g/cm$^3$.

10. An artificial grain leather defined in claim 4, wherein thickness of said coating layer varies over the surface of said fibrous substrate and said pores are locally concentrated at unelevated areas of the surface.

11. An artificial grain leather comprising a fibrous substrate and a coating layer, said substrate comprising a body portion comprising a multiplicity of entangled ultrafine fibers and opposed surface portions (a) and (B) both comprising a multiplicity of non-entangled ultrafine fibers, said coating layer comprising mainly an elastic high polymer, and said coating layer, said portion (A). said portion of entangled ultrafine fibers and said portion (B) being continuously connected in this order, wherein the fineness of the ultrafine fibers is less than 0.7 denier, the density of the non-entangled fibers is 50,000 to 250,000 fibers/cm$^2$, the length of the non-entangled fibers is 0.01 to 3.0 mm the coating layer is between 0.9 and 1.3 g/cm$^3$.

12. An artificial grain leather as defined in claim 11, wherein the density of the coating layer is between 7 and 30 times as great as the density of the portion (A).

13. An artificial grain leather defined in claim 11, wherein said coating layer has the plurality of pores.

14. An artificial grain leather defined as claim 13, wherein said pores are locally concentrated.

15. An artificial grain leather defined in claim 14, wherein thickness of said coating layer varies over the surface of said fibrous substrate and said pores are locally concentrated at unelevated areas of the surface.

* * * * *